United States Patent [19]

Sato

[11] Patent Number: 5,014,378

[45] **Date of Patent: * May 14, 1991**

[54] PNEUMATIC MAT WITH SAFETY APPARATUS

[75] Inventor: Hisashi Sato, Tokyo, Japan

[73] Assignee: Michiko Tsuchiya, Japan; a part interest

[ * ] Notice: The portion of the term of this patent subsequent to Nov. 8, 2005 has been disclaimed.

[21] Appl. No.: 432,539

[22] Filed: Nov. 7, 1989

[51] Int. Cl.[5] ..... A47C 27/08; A61G 7/005

[52] U.S. Cl. ..... 5/453; 5/455; 5/72

[58] Field of Search ..... 5/424, 433, 71, 72, 5/453, 455, 456; 137/224, 223; 254/93 HP

[56] References Cited

U.S. PATENT DOCUMENTS 4,099,276 7/1978 Hunt et al. ..... 5/455

4,625,348 12/1986 Renggli et al. ..... 5/433

4,782,542 11/1988 Sato ..... 5/453

FOREIGN PATENT DOCUMENTS 1217571 5/1966 Fed. Rep. of Germany ... 254/93 HP

*Primary Examiner*—Alexander Grosz

*Attorney, Agent, or Firm*—Steinberg & Raskin

[57] ABSTRACT

A pneumatic bed having an inflatable member, a fixed member, a valve, and an element having a port in which the valve is seated. This element normally confines inflation gas supplied to the inflatable member, and is normally movable with respect to the fixed member upon inflation of the inflatable member. A flexible member is also provided which extends between the fixed member and the valve, for unseating the valve when the element is moved beyond a predetermined point with respect to the fixed member, when the inflatable member is inflated beyond a predetermined limit.

8 Claims, 5 Drawing Sheets

PNEUMATIC MAT WITH SAFETY APPARATUS

BACKGROUND OF THE INVENTION

The present invention is directed to a safety apparatus for a pneumatic bed, which prevents the bed from being raised or inflated beyond a certain level. More particularly, the present invention relates to a pneumatic mat type bed designed for double-folding, i.e. raising an upper portion thereof with respect to a lower portion thereof so that an individual on the bed can sit up. The bed is provided with a plurality of small-size pneumatic mats, with gas such as air either fed to or exhausted from the respective mats to inflate or delfate the same, e.g. through control by a computer. An inflatable member such as an air bag is installed on the upper section or half of the bed, to raise the same, with the safety mechanism being provided to prevent the upper part of the bed from raising or springing up more than a predetermined extent, due to any failure of the computer or other mechanisms to arrest the flow of gas or air into the air bag.

The present invention is also directed to a plurality of pneumatic mats for a pneumatic type bed, with each individual pneumatic mat being provided with such a safety apparatus. An electromagnetic valve is provided through which gas such as air is fed to or exhausted from the respective pneumatic mat, e.g. through control by a computer.

A prior pneumatic mat-type bed has been formed by a plurality of pneumatic mats, allowing a user who is incapacitated or who can move only with great difficulty, to raise individual parts of his body, e.g. his legs, head, left or right body half, or his back, by himself or with the aid of a helper. The bed can be so raised through the operation of a computer by the user, or the user's helper, in order to protect the user from various ailments by being bedridden, e.g. bed sores or poor blood circulation.

Recently, a pneumatic mat-type bed designed for double-folding has been developed, wherein the upper half of the bed is raised or springs up by inflation of an air bag.

A prior pneumatic mat-type bed has also been constituted by several small size pneumatic mats, each formed as a bellows between an upper plate thereof and a bottom plate thereof, with gas such as air being fed to or exhausted from the bellows through a pipe and a gas feeding/exhaust valve, under the control of a computer.

The problem of these previously-used beds, is that the air or gas bag may spring up to an undesired extent due to misoperation of or a fault in the controlling mechanism for inflating the bag, which would extremely discomfort the user, e.g. a patient. At the worst, the gas bag could explode. By the same token, a problem with the prior art pneumatic-type beds utilizing the individual mats or bellows-type members, is that if gas feeding is not arrested due to some possible malfunctioning of the computer, then a user e.g. a patient) of the bed having the pneumatic mats may be thrown off or dropped off the bed, or the pneumatic mats might even explode. Thus, there is a need for provision of some safety means or mechanism to prevent these accidents from occurring, especially to a patient who is an invalid, i.e. cannot move by himself.

SUMMARY OF THE INVENTION

Accordingly, it is an object of the present invention to provide for the safe, effective operation of a pneumatic bed for an incapacitated individual.

It is also an object of the present invention to prevent inordinate inflation or movement of any portion of a pneumatic bed with respect to the other portions thereof.

It is another object of the present invention to provide for safe release of gas from a pneumatic bed, to prevent any possible explosion thereof.

It is a further object of the present invention to provide a good cushioning effect in a pneumatic bed, so that a user thereof is not sharply jolted.

These and other objects are attained by the present invention which is directed to a pneumatic bed, comprising an inflatable member, a fixed member, a valve, and an element having a port in which the valve is seated. This element normally confines inflation gas supplied to the inflatable member, and is normally movable with respect to the fixed member upon inflation of the inflatable member. Additionally, flexible member means are provided to extend between the fixed member and the valve, for unseating the valve when the element is moved beyond a predetermined point with respect to the fixed member when the inflatable member is inflated beyond a predetermined limit.

Thus, to resolve the above-noted problems, the pneumatic mat-type bed is provided with a safety apparatus connected to a gas feeding pipe conduit for the inflatable member, and which is designed to allow gas or air within the inflatable member to exit therefrom, if the upper half of the pneumatic type bed springs up beyond a predetermined angle. By the same token, the above problems are resolved by positioning of an exhaust hole or port on an upper plate of each small-size pneumatic mat, and by mounting a safety apparatus within the pneumatic mat, the safety apparatus having a valve to close the exhaust hole.

More particularly, an air or gas exhaust hole is provided in the air or gas feeding pipe or conduit for the inflatable member such as an air bag, with the safety apparatus having an exhaust valve installed therein, the exhaust valve disposed to close the air or gas exhaust hole tightly, when the upper half of the pneumatic bed is below the predetermined angle, i.e. the predetermined limit.

By the same token, the present invention resolves the above-noted problems by providing the safety apparatus in each pneumatic mat of a plurality of the small-size pneumatic mats, each such mat being constituted by a bellows situated between an upper movable plate and a lower fixed plate. A pipe for feeding gas or air is mounted onto the bellows, with an electromagnetic valve being provided in order to both feed air or to exhaust the same from the bellows through the electromagnetic valve. Additionally, an air exhaust hole is formed through the upper plate of the pneumatic mat with a valve forming part of the safety apparatus being situated to close this exhaust hole under normal condition. More particularly, a frame is situated within the pneumatic mat, and through which a shaft of the valve is mounted for sliding. A coil spring is also provided as part of the safety apparatus within each such pneumatic mat, with the sliding shaft mounted through the coil spring, and the spring mounted onto the inside of the upper plate so that the valve closes the exhaust hole tightly from the inside. Flexible member means such as a rope are fixed to the lower end of the sliding shaft, and are also fixed to the bottom plate of the mat, at an opposite end thereof.

BRIEF DESCRIPTION OF THE DRAWINGS

The present invention will now be described in greater detail with reference to the accompanying drawings in which.

DESCRIPTION OF THE PREFERRED EMBODIMENTS

Figure 1:
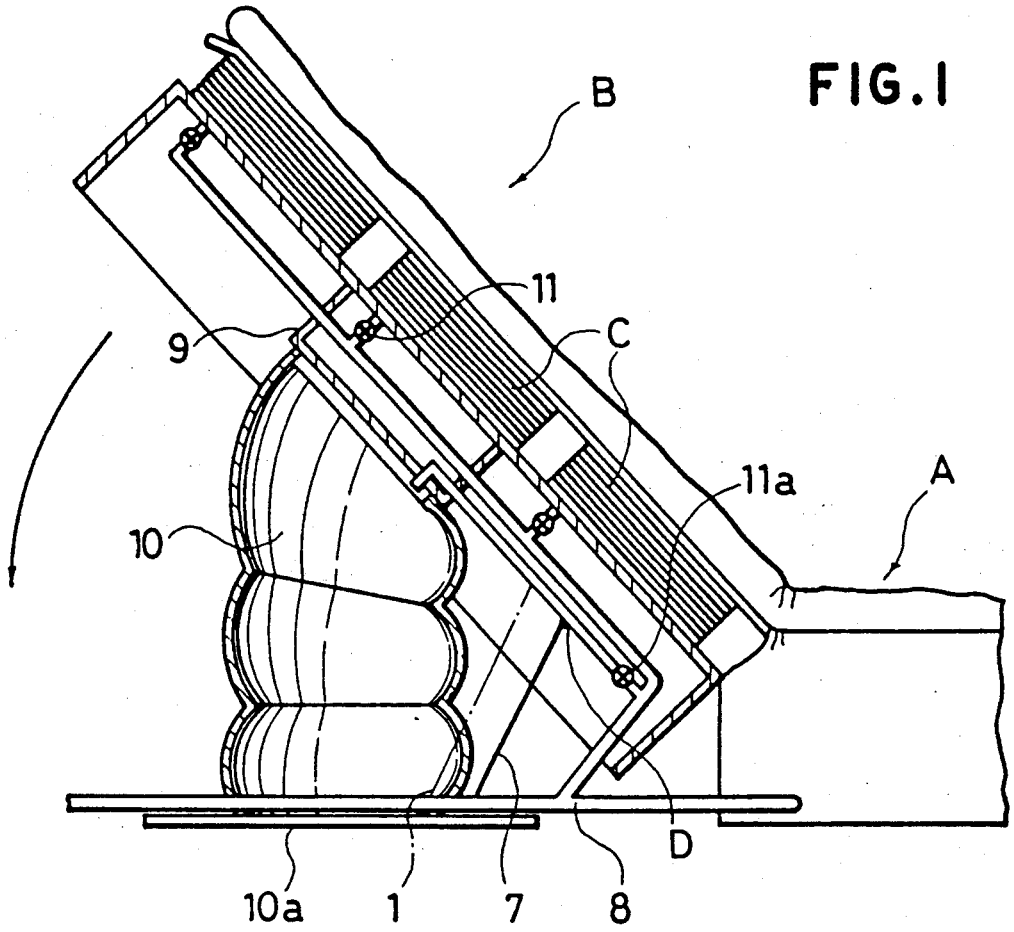
FIG. 1 is a side elevational view, partially in section, of a pneumatic-type bed in accordance with the present invention.
Figure 2:
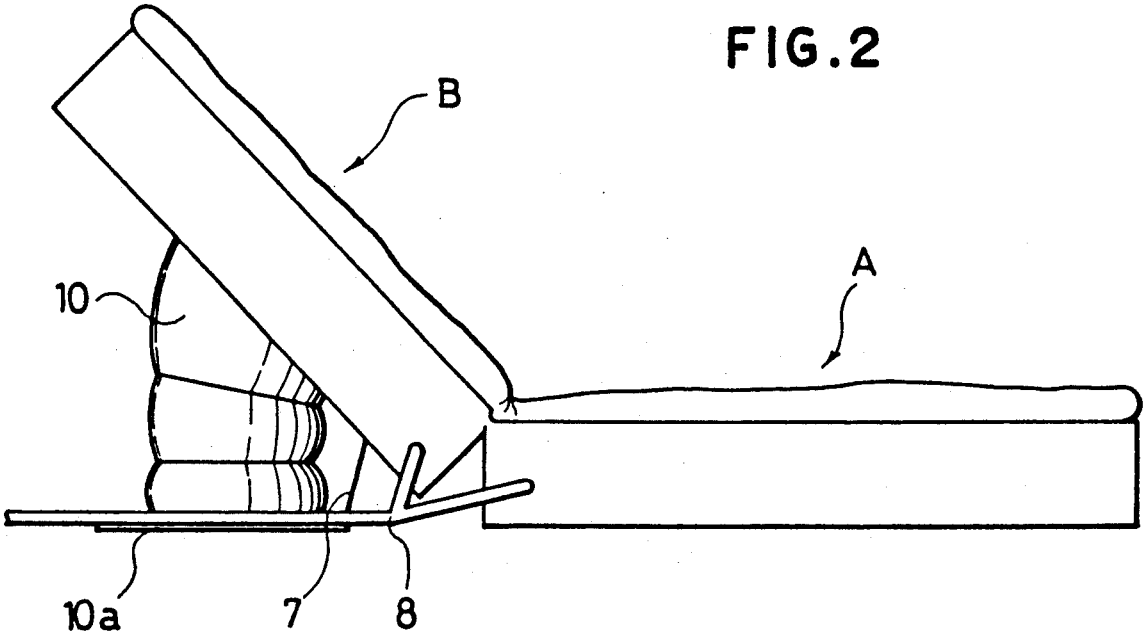
FIG. 2 is also a side view of a pneumatic bed of the present invention, in which an upper portion thereof has been raised or sprung up.

Referring to FIGS. 1–4, symbols A, B, C, and D respectively illustrate the overall bed body or structure, an upper portion of the bed which is designed to be raised or spring up with respect to a lower portion thereof, one of small-size air or gas mats installed upon the bed, and a safety apparatus for the bed.

More particularly, referring to FIGS. 1–4, an air or gas feeding conduit pipe 1 is used to feed air or gas to an inflatable member such as an air bag 10 through an air feeding/exhaust electromagnetic valve 11*a*, and is branched from the gas or air feeding pipe or conduit 8 which is used to feed air or gas from a separately-installed air compressor to each small-size air mat C. A computer is intended to operate and control the air feeding/exhaust electromagnetic valve 11*a*, to appropriately feed air through the air feeding conduit 1 into the air bag 10, so that the upper half B of the bed A springs up.

A fixing nut 2 is used to fix the safety apparatus D within the air feeding pipe 1 for the air bag 10, with the screw 3 of the safety apparatus D. This screw 3 has an inserting hole at the center thereof, into which a sliding shaft 5 is provided, with a valve 6 fitted at the top of the sliding shaft as illustrated. This sliding shaft is mounted for free sliding with respect to the screw 3, i.e. for free sliding or movement with respect to the air feeding pipe 1. Additionally, a coil spring 4 is fitted against the valve 6 and extends around the shaft 5 as illustrated, so that the valve 6 is always pushed or biased upwardly, i.e. into hole or port 6*a* through a wall of the air feeding pipe 1. Thus, the coil spring 4 biases the valve 6 to keep the exhaust air hole or port 6*a* sealed.

Flexible member means 7 are also provided, which can be a rope, wire, cord, or spring. One end of the e.g. rope 7 is fixed to a lower end of the sliding shaft 5, while the other end of the rope 7 if fixed to a mounting plate 10*a* of the air bag 10 as illustrated. Therefore, the flexible member means extend between a fixed member 10*a* and the valve 6.

Figure 4:
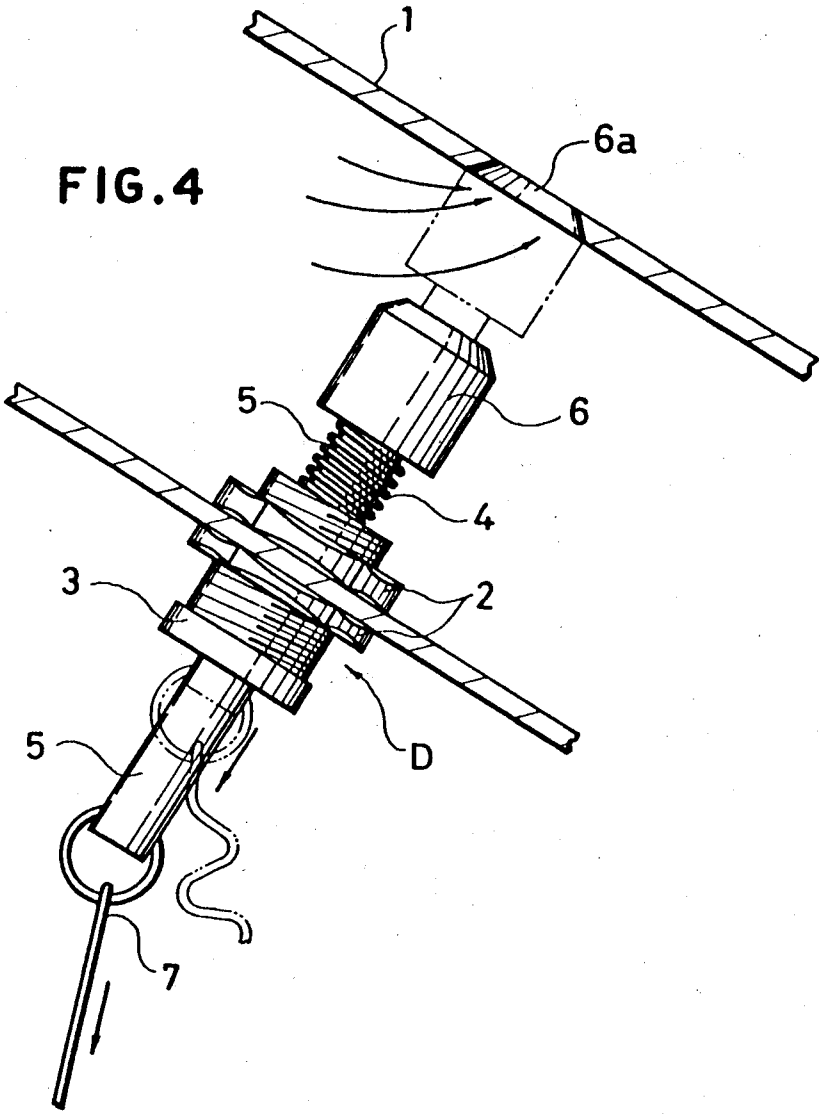
FIG. 4 is a view similar to FIG. 3, illustrating the safety apparatus of the bed of the present invention in operation.
Figure 3:
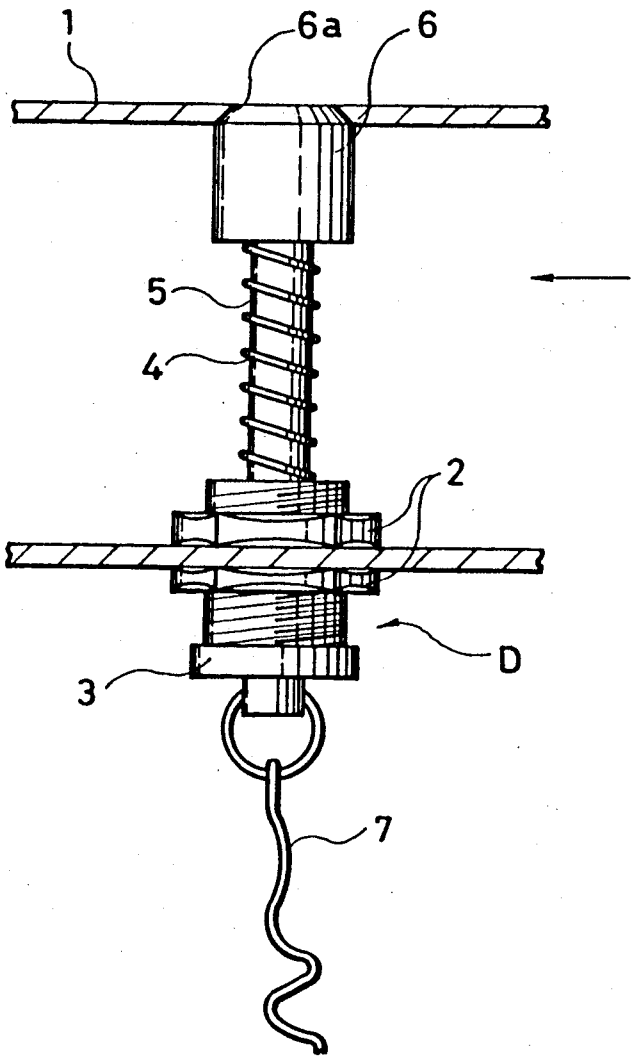
FIG. 3 is a sectional view of the internal construction of a safety apparatus in accordance with the bed of the present invention.

The flexible member means, e.g. rope 7 is normally loosened as illustrated in FIG. 3. However, if the upper half B of the bed A springs up, then the rope 7 becomes strained as illustrated in FIG. 4. Also, if the upper half B of the bed A springs up beyond a predetermined point, e.g. a predetermined angle, then the sliding shaft 5 is strained. If the sliding shaft 5 becomes strained, then the valve 6 is moved downwardly as illustrated in FIG. 4 to exhaust air from the air bag 10 through the exhaust air port 6*a*, thus preventing the upper half B of the bed A from springing up any further.

The air bag 10 itself, is formed of an elastic material capable of being folded as a bellows, and is mounted onto the air bag fixing section C installed inside of the upper half B of the bed A. As shown in FIG. 1, the air bag 10 is supplied with gas or air through the air feeding pipe 1 for the air bag 10, which in turn, is branched off from the air feeding pipe 8 and connected to the air bag 10 through an electromagnetic valve 11*a* for air feeding or exhaust.

An electromagnetic valve 11 is provided for feeding or exhausting gas or air to a plurality of small-size air matc C installed both on the lower portion of the bed structure A and on the upper half B of the bed A. These small-size air mats C are expanded or contracted through feeding of air or exhausting of the air from the same, which is provided by the air compressor under computer control, and is also disposed to stop and retain gas or air within each mat C at a particular level. Each small-size air mat C is designed to function independently from all other mats c, so that a specific contour of the bed A, can be attained.

Therefore, according to the present invention, the safety apparatus D is disposed to prevent the upper half B of the bed A from springing up more than a predetermined extent in case of failure of operation of the air feeding-exhaust electromagnetic valve 11*a* under computerized control. In other words, should the electromagnetic valve 11*a* fail to operate due to some reason, causing the upper half B of the bed A to spring up more than a predetermined extent, then the rope 7 pulls the valve 6 to exhaust air from the air bag 10 through the port 6*a*. This double safety mechanism ensures safe sleeping of a user.

The present invention also eliminates the possible danger of the air bag 10 exploding due to failure of the air feeding/exhaust electromagnetic valve 11*a* in the air feeding pipe 1, also ensuring an extremely high degree of safety. Additionally, the valve 6 may be adapted to reseat within the hole or port 6*a*, when the upper portion B of the bed A is lowered below the predetermined angle of elevation.

Figure 5:
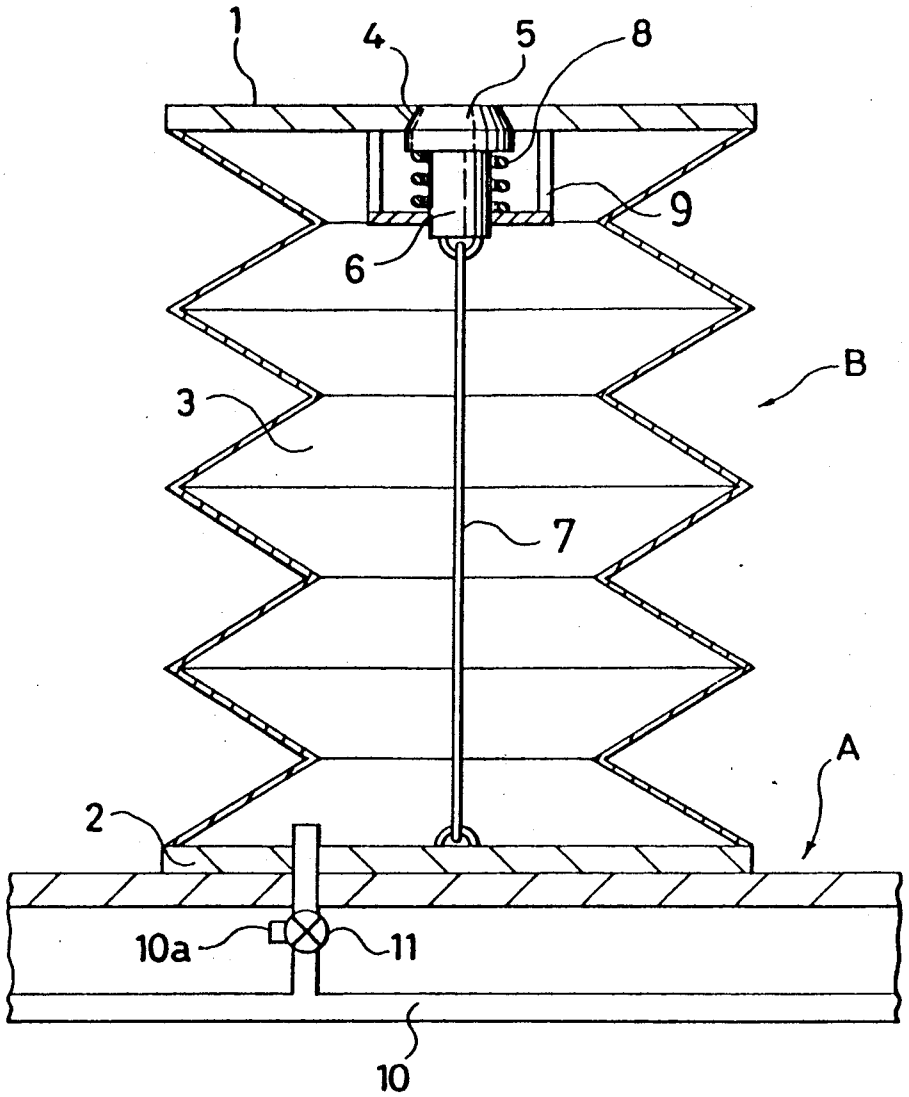
FIG. 5 is a sectional view of an individual mat of the pneumatic bed of the present invention, having the safety apparatus therein.

Referring to FIGS. 5–9, symbols A and B in each particular figure indicate a bed and a small-size pneumatic mat B, respectively. An upper plate 1 is situated on the top of the small-size pneumatic mat B, and has an exhaust hole 4 provided at the center thereof as illustrated (FIG. 5). The opposite end of the mat B is provided with a bottom plate 2, with the overall mat B being formed with a bellows structure as illustrated. An air or gas feed pipe 10 is situated through the bottom plate 2, with an electromagnetic valve 11 for feeding and exhausting the gas or air being provided in the pipe 10. The electromagnetic valve 11 is operated by a computer, whereby gas such as air is fed or exhausted to and from the mat B, which in turn expands or contracts the pneumatic mat B.

The bellows 3 is formed of an elastic material such as rubber. The air fed from an air compressor (not illustrated) to the bellows 3 is controlled by the electromagnetic valve 11 for air or gas feeding and exhaust, whereby the bellows 3 expands or contracts, according to a predetermined computer program, as noted above.

Figure 8:
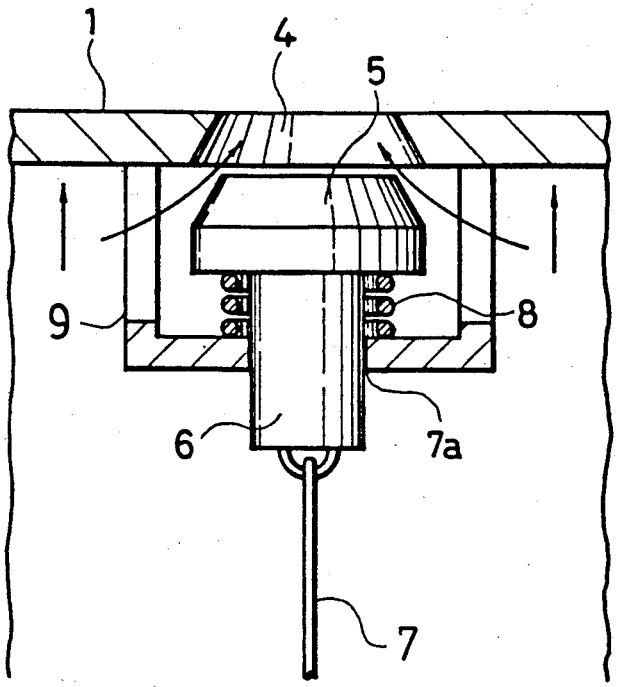
Figure 8:
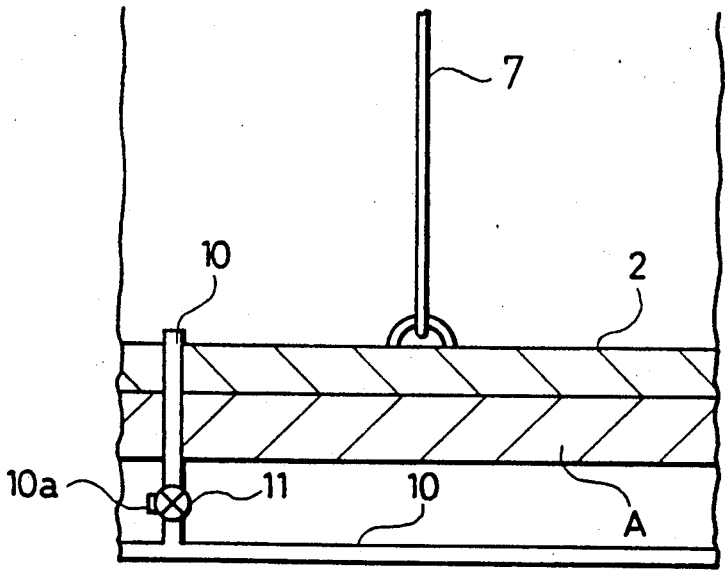
Figure 9:
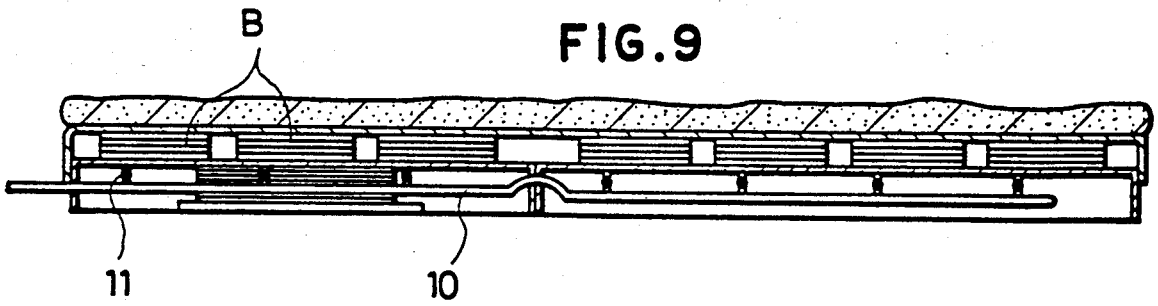
FIG. 9 is a side sectional view of a pneumatic-type bed of the present invention incorporating the safety apparatus.

If more than a prescribed volume of air is fed into the small-size pneumatic mat B due to some reason, and the small-size pneumatic mat B expands to an unnecessary extent, then the exhaust hole 4 provides a clearance away from the valve 5 which is connected to a sliding shaft 6 that is strained by a rope 7, and air is exhausted through the clearance and hole 4 to prevent the pneumatic mat B from expanding any greater (FIG. 8).

Figure 6:
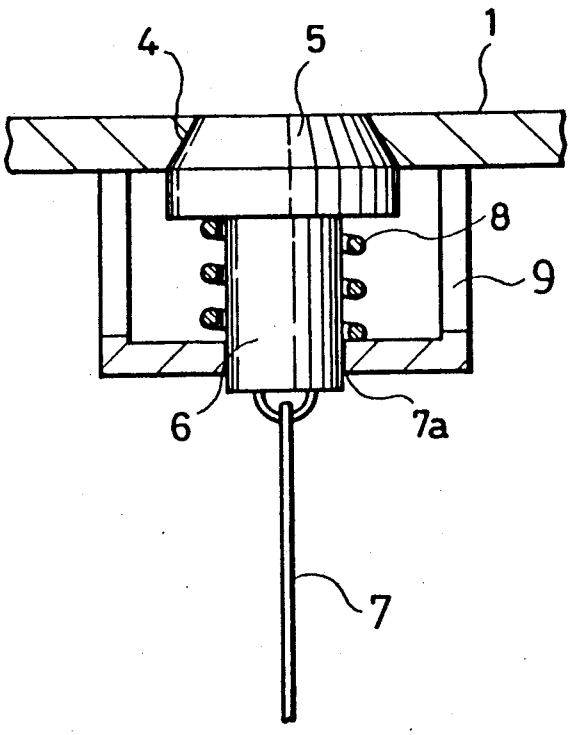
FIG. 6 is an enlarged view of a portion of FIG. 5, illustrating the safety apparatus of the present invention in greater detail.

More particularly, the valve 5 is disposed to normally close or seat against the exhaust hole or port 4 formed through the upper plate 1, with a lower portion of the valve 5 provided with a sliding shaft 6, as best seen in FIG. 6. The sliding shaft 6 of the valve 5 is fitted, for free sliding with respect to the upper plate 1, through a coil spring 8 and through a sliding hole 7*a* installed at the center of a mounting frame 9, which is in turn fixed inside the upper plate 1, so that the valve 5 may normally close the exhaust port 4 tightly. The valve 5 is always biased upwardly by the coil spring 8 as illustrated.

More particularly, the flexible member means may be constituted by the rope 7, or by a wire, cord, or spring, interconnecting the valve 5 and a fixed member, i.e. the bottom mounting plate 2 of the mat B. The flexible member means so interconnect the valve 6 and fixed member 2, such that when the mat B is inflated beyond a predetermined limit, the flexible member means are tensioned and unseat the valve 5 from the port 4.

Figure 7:
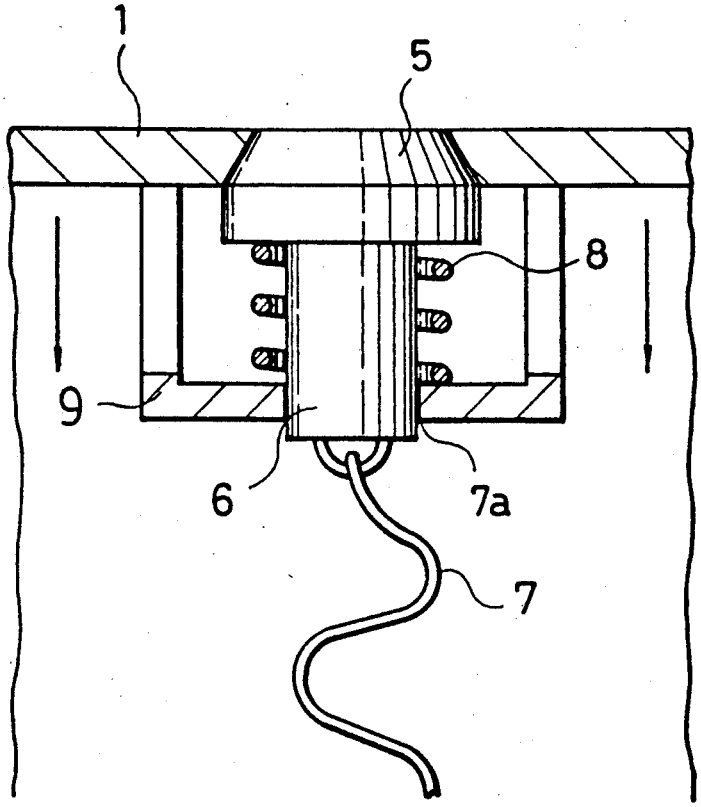
FIGS. 7 and 8 are sectional views illustrating the safety apparatus of the pneumatic-type bed of the present invention in operation.
Figure 7:
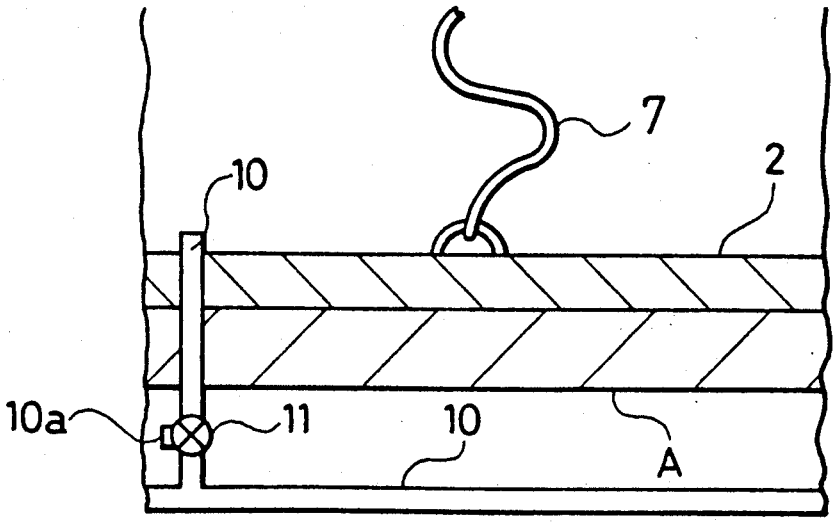

In the illustrated embodiment, one end of the rope 9 is fixed to the bottom of the sliding shaft 6, while the other end of the rope 7 is fixed to the bottom plate 2 of the small-size pneumatic mat B. This means that the rope 7 loosens, if the small-size pneumatic mat B contracts (FIG. 7).

The air feeding pipe 10 feeds air or gas fed by the air compressor (not illustrated) to the small size pneumatic mat B. This fed air is controlled by the electromagnetic valve 11 for air feeding and exhaust. This electromagnetic valve 11 feeds or exhausts air by computer (not illustrated). The air is fed through the air feeding pipe 10, while air or gas is exhausted through the air exhaust pipe 10*a*.

According to the present invention, the pneumatic mat B provides the following effects. Each pneumatic mat B installed on the pneumatic mat-type bed A is intended to operate under computerized control to prevent unnecessary volume of air to be fed to the same. Additionally, if the computer or the electromagnetic valve 11 for feeding and exhausting of air should fail to operate, allowing an unnecessary volume of air to enter into the pneumatic mat B and expanding the same, then a clearance is formed between the exhaust valve 5 and the exhaust hole 4, allowing the unnecessary volume of air to exit out of the pneumatic mat B to prevent unnecessary expansion of the mat B. This is accomplished because the sliding shaft 6 fixed to the valve 5 is pulled downwardly by the tensioned rope 7, as best seen in FIG. 8.

Accordingly, the present invention provides a double safety apparatus which ensures the safe sleeping of a user on the bed A provided with a plurality of pneumatic mats B, in accordance with the present invention.

Additionally, if a clearance is formed between the exhaust port or hole 4 and the valve 5, allowing the air in the pneumatic mat B to exhaust from the mat B and contracting the same to the predetermined height, then the clearance between the exhaust hole 4 and the valve 5 is completely closed (FIG. 7), with the exhaust hole or port 4 also being completely closed due to the coil spring 8 biasing, thus protecting a user from being subjected to unnecessary impact of deflation of the mat B.

The preceding description of the present invention is merely exemplary, and is not intended to limit the scope thereof in any way.

What is claimed is:

1. A pneumatic bed, comprising:

an inflatable member situated in an upper portion of said bed, for raising or lowering the same with respect to a lower portion of said bed, a fixed member, a valve, a conduit supplying inflation gas to the inflatable member and having a port in which said valve is seated, said conduit normally confining inflation gas supplied to said inflatable member, said conduit normally being movable with respect to said fixed member upon inflation of said inflatable member, and flexible member means extending between said fixed member and said valve, for unseating said valve when said conduit is moved beyond a predetermined point with respect to said fixed member when said inflatable member is inflated beyond a predetermined limit.

2. The bed of claim 1, wherein said valve is situated within said conduit.

3. The bed of claim 2, additionally comprising:

a shaft fitted against said valve, and connected to said flexible member means, said shaft mounted for free sliding with respect to said element, and spring means for biasing said valve to seat in said port, said spring means extending about said shaft.

4. The bed of claim 3, additionally comprising:

a hole in said element through which said shaft extends for free sliding with respect to said element, and a fixing nut for fixing said valve and spring means within said conduit.

5. The bed of claim 1, wherein said flexible member means are constituted by one of a rope, wire, cord, or spring interconnecting said valve and said fixed member such that when said upper portion of said bed is raised beyond said predetermined point, said flexible member means are tensioned and unseat said valve from said port.

6. The bed of claim 5, wherein said valve is disposed to reseat in said port when said upper portion of said bed is lowered below said predetermined point.

7. The bed of claim 1, additionally comprising:

a plurality of pneumatic mats each fixed on said bed, means for feeding gas to each of said pneumatic mats and connected with said conduit, and valve means for controlling flow of gas to each of said pneumtic mats and to said inflatable members.

8. The bed of claim 1, wherein said inflatable member is a bellows.

* * * * *